US005512867A

United States Patent [19]

Shibuta et al.

[11] Patent Number: 5,512,867

[45] Date of Patent: Apr. 30, 1996

[54] HIGH TEMPERATURE SUPERCONDUCTING COIL AND METHOD OF MANUFACTURING THEREOF

[75] Inventors: Nobuhiro Shibuta; Kenichi Sato; Hidehito Mukai; Takato Masuda, all of Osaka, Japan

[73] Assignee: Sumitomo Electric Industries, Ltd., Japan

[21] Appl. No.: 385,571

[22] Filed: Feb. 8, 1995

Related U.S. Application Data

[63] Continuation of Ser. No. 862,619, Apr. 1, 1992, abandoned.

[30] Foreign Application Priority Data

Apr. 2, 1991 [JP] Japan ..... 3-069755

[51] Int. Cl.[6] ..... H01F 6/06

[52] U.S. Cl. ..... 335/216; 505/705; 505/879; 505/880; 336/DIG. 1

[58] Field of Search ..... 335/216; 336/DIG. 1; 174/125.1, 15.4, 15.5; 505/166, 211, 230–232, 704, 705, 879, 880

[56] References Cited

U.S. PATENT DOCUMENTS

| | | | |
|---|---|---|---|
| 4,640,005 | 2/1987 | Mine et al. | 29/599 |
| 4,763,404 | 8/1988 | Coffey et al. | 29/599 |
| 4,902,995 | 2/1990 | Vermilyea | 335/216 |
| 4,904,970 | 2/1990 | Srivastava | 335/216 |
| 4,994,633 | 2/1991 | Puhn | 174/125.1 |
| 5,111,172 | 5/1992 | Laskaris | 335/216 |
| 5,376,755 | 12/1994 | Negm et al. | 505/231 |
| 5,384,197 | 1/1995 | Koyama et al. | 428/457 |

FOREIGN PATENT DOCUMENTS

| | | |
|---|---|---|
| 1119669 | 3/1982 | Canada . |
| 282286 | 9/1988 | European Pat. Off. . |
| 119002 | 5/1989 | Japan . |

OTHER PUBLICATIONS

Patent Abstracts of Japan, vol. 13, No. 97 (E–723)(3445) 7 Mar. 1989 & JP–A–63 272017.

Patent Abstracts of Japan, vol. 13, No. 352 (E–801)(3700) 8 Aug. 1989 & JP–A–110710.

Yasuzo Tanaka: "YBCO Superconducting Coils Operated at Nitrogen Temperature", Japanese Journal of Applied Physics vol. 27, No. 5, May 1988, Tokyo JP pp. 799–801.

*Primary Examiner*—Leo P. Picard
*Assistant Examiner*—Raymond M. Barrera
*Attorney, Agent, or Firm*—Pennie & Edmonds

[57] ABSTRACT

A high temperature superconducting coil includes an oxide superconducting wire 2 wound in a coil, a container 3 for accommodating the superconducting wire 2, and a filling resin portion 4 for fixing the superconducting wire 2 in the container 3 by being injected into the container 3 and then cured.

3 Claims, 1 Drawing Sheet

HIGH TEMPERATURE SUPERCONDUCTING COIL AND METHOD OF MANUFACTURING THEREOF

This is a continuation of application Ser. No. 07/862,619, filed Apr. 1, 1992, now abandoned.

BACKGROUND OF THE INVENTION

1. Field of the Invention

The present invention relates to a high temperature superconducting coil where an oxide superconducting wire is wound in a coil and also relates to a method of manufacturing thereof.

2. Description of the Background Art

A high temperature superconductive material known as a ceramics based superconductor is under study to be used as a thin tape type wire by applying plastic working to a high temperature superconductor while being metal-coated. The combination of such plastic working and thermal treatment can result in obtaining a tape type oxide superconducting wire having high critical density. The application of such a tape type oxide superconducting wire is now being considered to bus bar conductors, cable conductors, coils, etc.

However, such an oxide superconducting wire had a characteristic problem of low resistance to mechanical strain. Therefore, a coil formed of an oxide superconducting wire had a problem of degraded performance caused by thermal strain during a thermal heat cycle and mechanical strain by the electromagnetic force of the coil itself.

SUMMARY OF THE INVENTION

An object of the present invention is to provide a high temperature superconducting coil that can have thermal strain and mechanical strain reduced.

Another object of the present invention is to provide a method of manufacturing a high temperature superconducting coil that can have thermal strain and mechanical strain reduced.

A high temperature superconducting coil according to the present invention includes: an oxide superconducting wire wound in a coil; a container for accommodating the superconducting wire; and a filling resin portion for fixing the superconducting wire within the container by being injected into the container and then cured.

In the present invention, the container accommodating the superconducting wire is preferably a non-magnetic material such as stainless and FRP.

The resin injected into the container is preferably an organic based material such as an epoxy based resin. Also, the resin injected into the container is preferably cured without any additional treatment.

The filling resin portion preferably has a thermal expansion coefficient substantially identical to that of the container or the metal coating the oxide superconducting wire. Also, one having great mechanical strain at the time of low temperature is preferable.

A method of manufacturing a high temperature superconducting coil according to the present invention comprises the steps of: winding an oxide superconducting wire in a coil, accommodating said wound superconducting wire in a container, and injecting a filling resin into said container and curing the resin for fixing said superconducting wire in the container.

The high temperature superconducting coil according to the present invention can have the behavior caused by difference in temperature of the wire suppressed at the time of the heat cycle to reduce mechanical strain, since the oxide superconducting wire wound in a coil is fixed by a resin filling portion of epoxy based resin.

Furthermore, mechanical reinforcement is established even towards the electromagnetic force of the coil itself to prevent degradation of the coil performance, by being accommodated into a container of non-ferrous metal such as stainless, followed by injection, impregnation and curing of an epoxy type resin and the like.

Therefore, the high temperature superconducting coil according to the present invention can be applied to super high magnetic field magnetic in liquid helium and the like. It is known that an oxide superconducting wire is superior to the current alloy based and compound based superconducting wires in high magnetic field. The oxide superconducting wire can be used in magnetic coils or inner coils for superhigh magnetic fields that cannot be achieved with alloy based or compound based superconducting wires.

The foregoing and the objects, features aspects and advantages of the present invention will become more apparent from the following detailed description of the present invention when taken in conjunction with the accompanying drawings.

DESCRIPTION OF THE PREFERRED EMBODIMENTS

Figure 1:
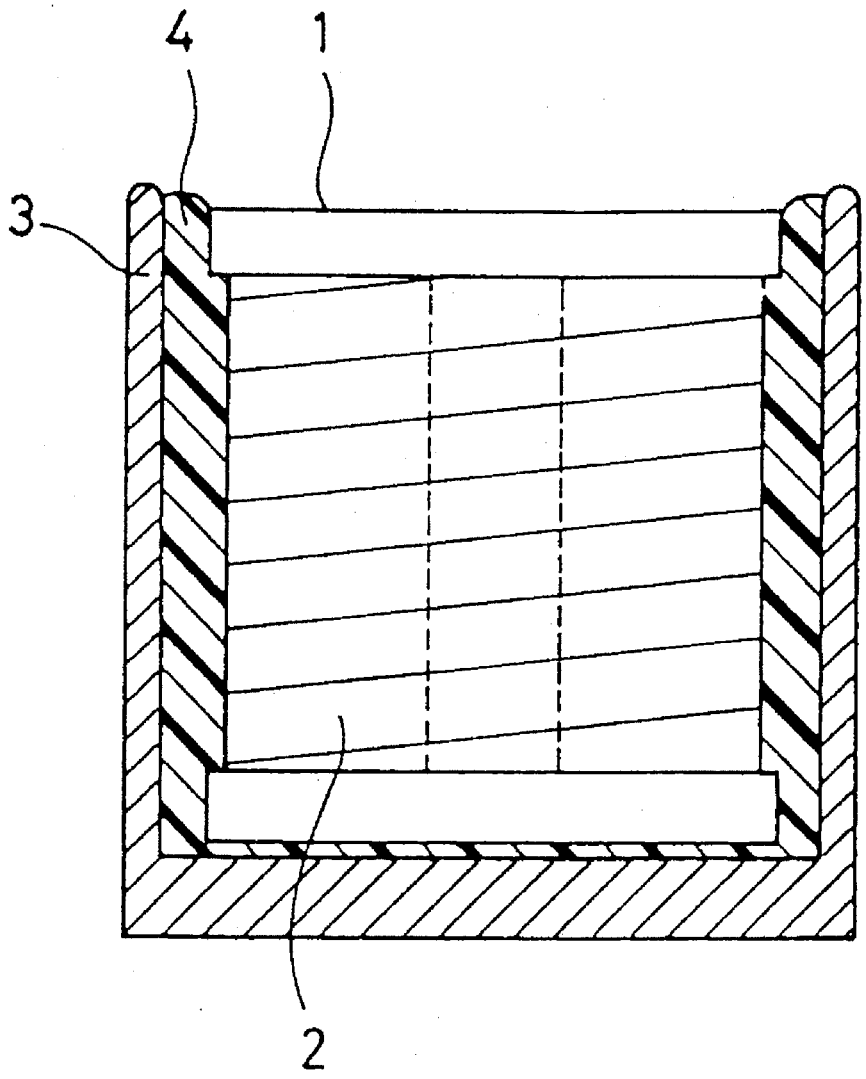
FIG. 1 is a sectional view of an embodiment of the present invention.

FIG. 1 is a sectional view showing an embodiment of the present invention. Referring to FIG. 1, an oxide superconducting wire 2 is wound in a coil around a stainless bobbin 1. The coiled oxide superconducting wire 2, as well as stainless bobbin 1, is accommodated in stainless container 3. After being accommodated in stainless container 3, an epoxy based adhesive 4 is injected into stainless container 3 and then cured. Thus, epoxy based adhesive 4 becomes the filling resin portion.

A double pancake coil was created placing ten layers of silver-sheathed Bi based high temperature superconducting wire of a thickness of 0.15 mm, a width of 4 mm, and a length of 2.7 m. This double pancake coil was placed in a stainless container having a wall thickness of 3 mm, where Stycast 2850FT (a product of Grace Japan Ltd.) is injected as the epoxy based adhesive to be completely cured. The performance was verified in liquid nitrogen, and the critical current Ic was 85A, and the maximum magnetic flux density Bm was 876 gauss.

This high temperature superconducting coil was dipped into liquid helium to which an external magnetic field was applied and measured. An external magnetic field of 1 tesla–6 tesla was applied to energize this superconducting coil. When an external magnetic field of 6 tesla was applied, the high temperature superconducting wire had an Ic of 400 A, and a Bm of 4120 gauss. The electromagnetic force was 164 kg/cm$^2$.

When the performance in liquid nitrogen was verified again afterwards, the Ic was 85 A, the Bm was 876 gauss, where no degradation in the coil performance was recognized.

As a comparison example, a double pancake coil similar to that used in the above embodiment was created and dipped in liquid nitrogen, wherein the performance was verified. The critical current Ic was 70 A, and the maximum magnetic flux density was 720 gauss. An external magnetic field was applied in liquid helium, and then measured. When an external magnetic field of 6 tesla was applied, the high temperature superconducting coil had an Ic of 250 A, and a Bm of 2570 gauss. The electromagnetic force at this time was 164 kg/cm$^2$.

When the performance was verified again in liquid nitrogen, as in the above embodiment, the Ic was 32 A, the Bm was 329 gauss, exhibiting degradation in coil performance.

It is apparent from the above-described embodiment and the comparison example that a high temperature superconducting coil can be obtained according to the present invention without degradation in performance caused by mechanical strain by thermal heat cycle and electromagnetic force.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A high temperature superconducting coil comprising:

a bobbin, an ensheathed oxide superconducting wire wound around said bobbin to form a coil, a rigid container for accommodating the coil, and a filling resin portion for fixing said coil in the container by being injected into said container and then cured.

2. A high temperature superconducting coil recited in claim 1, wherein said container is formed of non-magnetic material.

3. A high temperature superconducting coil recited in claim 1, wherein said filling resin portion has a thermal expansion coefficient substantially identical to that of the container.

* * * * *